US008164534B1

(12) United States Patent
Tam

(10) Patent No.: US 8,164,534 B1
(45) Date of Patent: Apr. 24, 2012

(54) CONVERSION OF AN ANTENNA TO MULTIBAND USING CURRENT PROBES

(75) Inventor: Daniel W. S. Tam, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 427 days.

(21) Appl. No.: 12/405,508

(22) Filed: Mar. 17, 2009

(51) Int. Cl.
*H01Q 1/00* (2006.01)
*H01Q 1/32* (2006.01)
*H01Q 9/00* (2006.01)
*H01Q 9/16* (2006.01)

(52) U.S. Cl. ..... 343/787; 343/715; 343/720; 343/749; 343/750; 343/792

(58) Field of Classification Search ..... 343/715, 343/720, 749, 750, 792, 880, 787
See application file for complete search history.

(56) References Cited

U.S. PATENT DOCUMENTS 4,117,493 A * 9/1978 Altmayer ..... 343/750
4,725,845 A * 2/1988 Phillips ..... 343/702
5,604,507 A * 2/1997 Openlander ..... 343/860
5,633,648 A * 5/1997 Fischer ..... 343/788
6,239,760 B1 * 5/2001 Van Voorhies ..... 343/742
6,492,956 B1 * 12/2002 Fischer et al. ..... 343/788
6,577,155 B2 * 6/2003 Stewart et al. ..... 326/32
6,956,535 B2 * 10/2005 Hart ..... 343/792

OTHER PUBLICATIONS

Unpublished U.S. Appl. No. 11/867,046, filed Oct. 4, 2007 by Daniel Tam et al., titled "Multiband Current Probe Fed Antenna."
Unpublished U.S. Appl. No. 12/330,307, filed Dec. 8, 2008 by Daniel Tam, titled, "Multiband Tree Antenna."

* cited by examiner

*Primary Examiner* — Jacob Y Choi
*Assistant Examiner* — Graham Smith
(74) *Attorney, Agent, or Firm* — Kyle Eppele; J. Eric Anderson

(57) ABSTRACT

A multi-band antenna comprising a conductive structure and a plurality of current probes coupled around the conductive structure is disclosed. An existing antenna capable of generating H fields having a first signal line is converted into a multi-signal line antenna with increased frequency capabilities, by mounting a first current probe having a designated frequency range about a periphery of the existing antenna; coupling a second signal line to the first current probe; and performing at least one of transmitting and receiving via at least one of the first and second signal lines, wherein the mounting of the first current probe to the existing antenna improves a voltage standing wave ratio (VSWR) of the existing antenna and the second signal line operates as an independent signal line for signal reception/transmission within the designated frequency range.

17 Claims, 16 Drawing Sheets

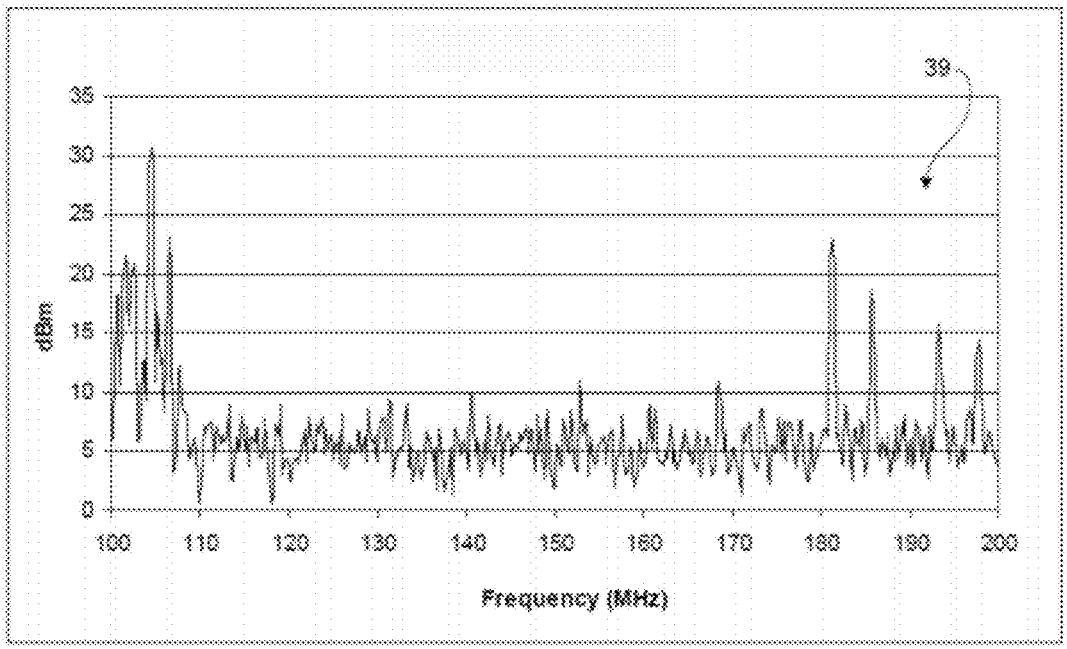
Fig. 5A
Fig. 5B
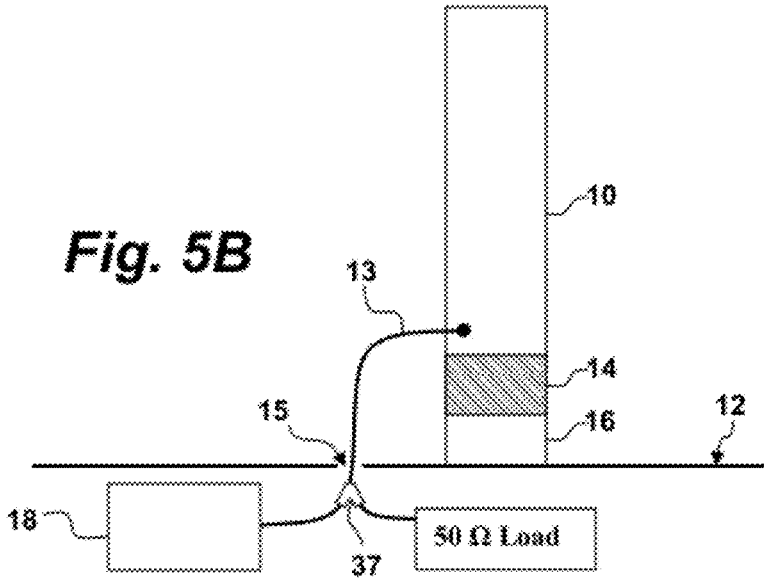

CONVERSION OF AN ANTENNA TO MULTIBAND USING CURRENT PROBES

FEDERALLY-SPONSORED RESEARCH AND DEVELOPMENT

This invention (Navy Case No. 098559) was developed with funds from the United States Department of the Navy. Licensing inquiries may be directed to the Office of Research and Technical Applications, Space and Naval Warfare Systems Center, San Diego, Code 72120, San Diego, Calif., 92152; voice 619-553-2778; email T2@spawar.navy.mil.

FIELD OF THE INVENTION

This disclosure relates to communication systems. More particularly, this disclosure relates to systems and methods for providing multiband signal capabilities for an antenna.

BACKGROUND OF THE INVENTION

With increasing numbers of wireless communications systems available today, more and more antennas are required to support them. In many situations the available real estate limits the number of additional antennas that may be added to a site. For example, the area available on building rooftops, and exterior surfaces of automobiles, aircraft, and vessels, which often serve as antenna placement locations, is particularly limited.

Conventional approaches to increasing capabilities have been to replace the existing antennas with a multiband antenna. However, the existing antennas are known to perform "well" and the replacement of such antennas often requires a significant investment of capital and resources, and also runs the risk of the existing capabilities being compromised in view of the "newer" antenna. An approach for "upgrading" existing antennas to have multiband or broadband capabilities, without the requirement of removing the existing antenna, is desirable. Methods and systems for addressing these and other needs in the art are disclosed herein.

SUMMARY

The foregoing needs are met, to a great extent, by the present disclosure, wherein systems and methods are provided that in some embodiments facilitate the modification of an existing antenna system to have multiple signal lines and broadband capability.

In accordance with one aspect of the present disclosure, a method for converting an existing antenna capable of generating H fields having a first signal line into a multi-signal line antenna with increased frequency capabilities is provided, comprising: mounting a first current probe having a designated frequency range about a periphery of the existing antenna; coupling a second signal line to the first current probe; and performing at least one of transmitting and receiving via at least one of the first and second signal lines, wherein the mounting of the first current probe to the existing antenna improves a voltage standing wave ratio (VSWR) of the existing antenna and the second signal line operates as an independent signal line for signal reception/transmission within the designated frequency range.

In accordance with another aspect of the present disclosure, an antenna system for converting an existing antenna capable of generating H fields having a first means for conveying a signal into a multi-signal line antenna with increased frequency capabilities is provided, comprising: first means for detecting H fields, the first means having a designated frequency range and being mounted about a periphery of the existing antenna; second means for conveying a signal to the first means for detecting; and means for performing at least one of transmitting and receiving via at least one of the first and second means for conveying, wherein the mounting of the first means for detecting to the existing antenna improves a voltage standing wave ratio (VSWR) of the existing antenna and the second means for conveying operates as an independent line for signal reception/transmission within the designated frequency range.

In accordance with yet another aspect of the present disclosure, an antenna system for converting an existing antenna capable of generating H fields having a first signal line into a multi-signal line antenna with increased frequency capabilities is provided, comprising: a first current probe having a designated frequency range mounted about a periphery of the existing antenna; a second signal line coupled to the first current probe; and at least one of a transmitter and receiver coupled to the at least one of the first and second signal lines, wherein the first current probe improves a voltage standing wave ratio (VSWR) of the existing antenna and the second signal line operates as an independent signal line for signal reception/transmission within the designated frequency range.

BRIEF DESCRIPTION OF THE DRAWINGS

FIG. 5A is a signal level plot of the test antenna setup of FIG. 1 with a splitter having a 50Ω termination attached.

FIG. 5B is an illustration of the test antenna setup of FIG. 1 with a splitter having a 50Ω termination attached.

DETAILED DESCRIPTION

Figure 1:
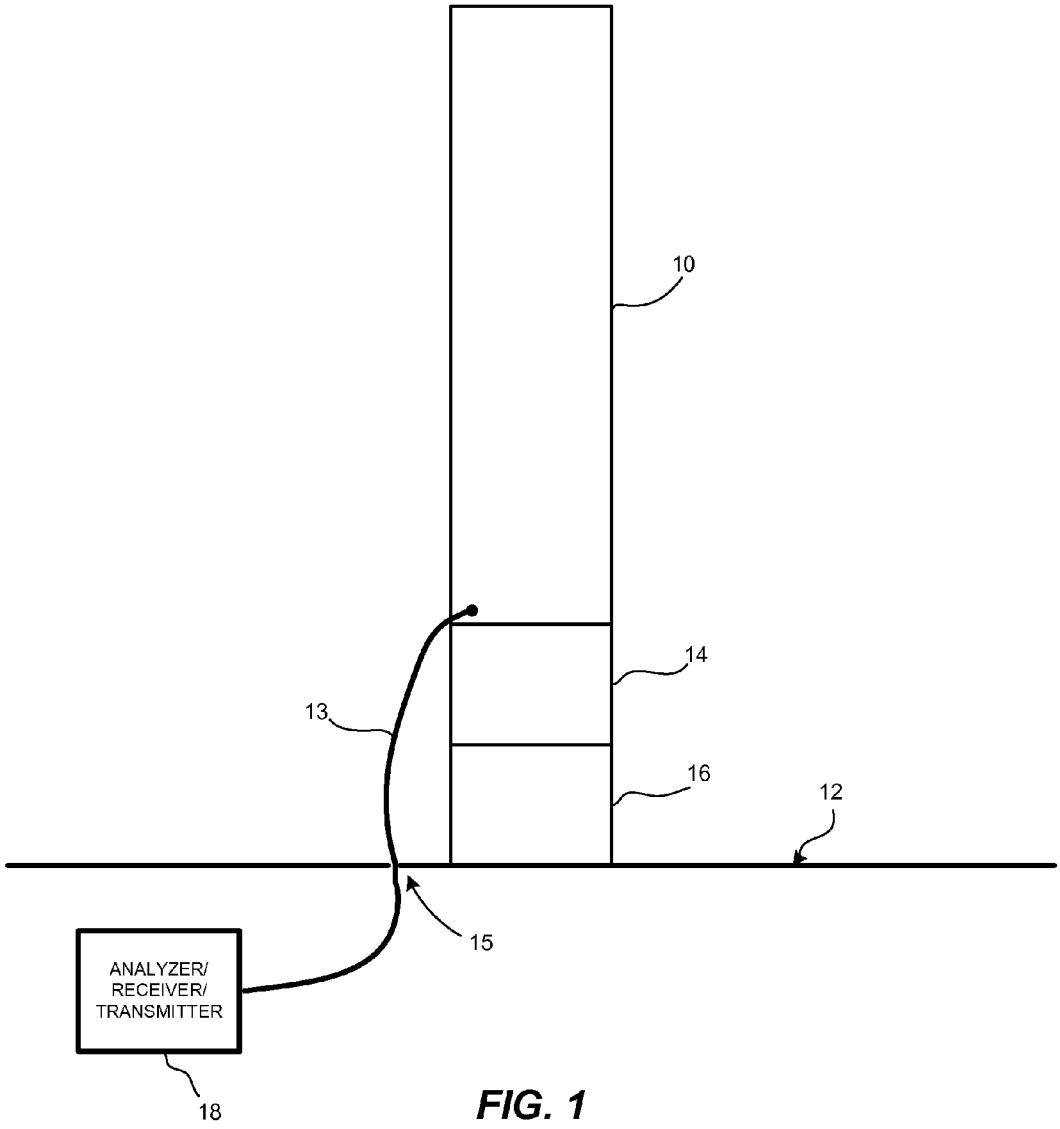
FIG. 1 is an illustration of a test antenna setup.

Due to limited real estate on deployment platforms, ships being an excellent example, collocated antenna systems are susceptible to electromagnetic interference to and from other antennas. Also, to be able to integrate additional antennas into these systems, antenna-to-antenna isolation must be managed to avoid the overloading of the RF front end stage of receivers. Typically with a shared antenna, a power divider can be attached to the antenna output port, causing the signal to be split between the various receivers (and/or transmitters). However, a power divider reduces the signal strength by as much as 3 dB or to the half power equivalent. For weak signals or for multi-split signals, this can result in signals that are below the detection threshold for the receiver.

There is a need to devise a way to convey signals from antennas without incurring the loss associated with a power divider, and also be able to modify existing antennas to have multiband capabilities. Magnetic coupling using current probes is investigated herein as one possible approach. The subject matter of current probes as antennas is discussed in co-pending patent application Ser. No. 11/867,046, titled "Multiband Current Probe Fed Antenna," filed Oct. 4, 2007, by inventors Daniel Tam et al., the contents of which are incorporated herein by reference in their entirety. Using first principles, for linear antennas—the incoming RF signal is the incident electric field, whereas the antenna's voltage is approximately the effective height of the antenna times the incident electric field. Since the antenna has a self-impedance, the antenna current is governed principally by the antenna's voltage divided by the self-impedance.

It is understood that the antenna's current generates a proportional magnetic field H about the antenna. A current probe, one non-limiting example being a mast clamp type current probe, can "pick up" the toroidal magnetic field H surrounding the antenna by placing the current probe around the antenna. The magnetic flux density B in the current probe is known to be the product of the ambient magnetic field H and the permeability $\mu$ of the core of the current probe, typically a ferrite core. The magnetic flux $\Phi$ in the core is a function of the cross section of the core and the magnetic flux density B. The changing magnetic flux $\Phi$ produces a voltage output by the one turn loop of the core of the current probe. This voltage signal can be coupled to a transmission line or signal line for indirectly reading the incident electric field (RF energy) received or even transmitted by the antenna. As long as the antenna impedance is not significantly perturbed by the placement of the current probes, the antenna's current and ensuing magnetic field H will not be significantly affected.

In various exemplary embodiments, a resonant antenna of the form of a ¼ wave resonator is used to demonstrate the exemplary principles described herein. Of course, as one of ordinary skill is aware, ½ wave or multiples of ¼ wave antennas can be used, as well as any antenna that generates a magnetic field H from current on the antenna. Therefore, variations to the type and shape of antenna, either resonant in form or non-resonant, may be made without departing from the spirit and scope of this disclosure.

Using a ¼ wave monopole antenna as a non-limiting example antenna shape, it is known that the current distribution is greatest at the base of the antenna. By placing current probes along the axis of the monopole antenna and near its base, the induced magnetic flux $\Phi$ will generate a voltage on the probe's output, which can be picked up by a receiver or signal analyzer. It is noted that although the current distribution is maximum at the base, this does not limit the locations at which the current probe can be placed. Depending on the sensitivity (or gain) of the current probe, it may be able to pick up the weaker magnetic fields H near the top of the antenna. Therefore, the capabilities of the current probes used will often dictate their ability to be placed at different locations on the antenna. Because of the reciprocity theorem, the same current distribution along the antenna allows the antenna to act both in receive mode and transmit mode. Therefore, the current probes can also be used for transmission.

FIG. 1 an illustration of a "pre-existing" antenna 10 over a ground plane 12. The antenna 10 is of a fat monopole configuration and separated from the ground plane 12 via a dielectric spacer 14 and a ground plane connector/antenna support 16 which is in electrical contact (grounded) with the ground plane 12. The antenna 10 is coupled to a signal analyzer/test system 18 via a cable 13 which is passed through a via 15 in the ground plane 12. It should be noted that in various embodiments, the signal analyzer/test system 18 may be replaced with a receiver and/or a transmitter.

The setup of FIG. 1 is of a test setup for validating the principles described herein, the analyzer 18 being an Anritsu Model S312D analyzer, the height of the antenna being approximately 24 inches and the diameter approximately 2 inches. The dielectric spacer 14 is approximately 1 inch in height and the ground plane connector 16 is approximately 1 inch in height. The test setup of FIG. 1 used a hollow brass cylinder as the antenna material and nylon as the dielectric spacer 14. The cable 13 was a flexible line and the ground plane 12 was approximately a 3 foot by 3 foot square. Since the antenna 10 is considered a fat monopole, it will exhibit a reasonable sensitivity over a moderate range of frequencies.

Figure 2:
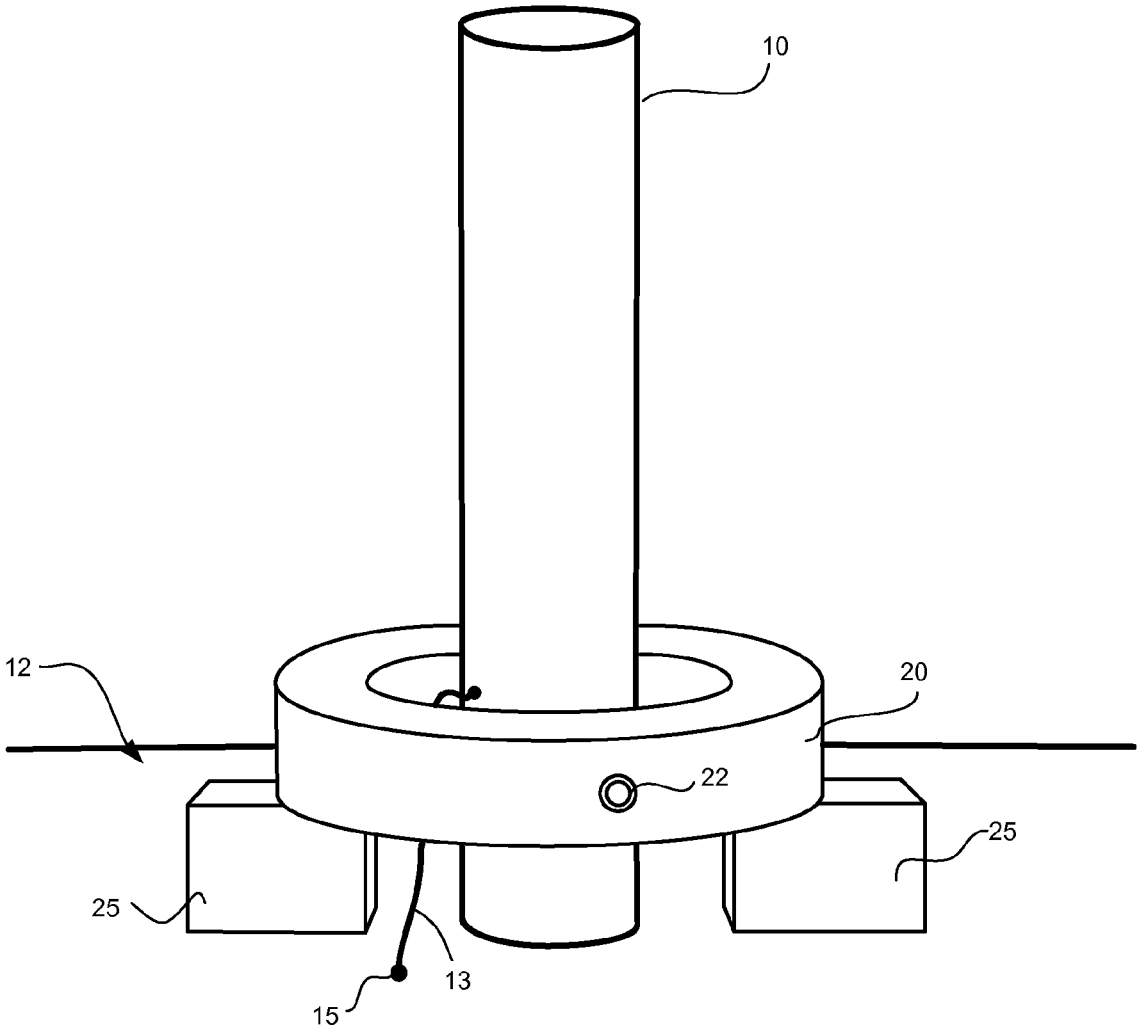
FIG. 2 is an illustration of the test antenna setup of FIG. 1 with a single current probe.

FIG. 2 is an illustration of the test antenna setup of FIG. 1 with a single current probe 20 with a signal coupler port 22. The current probe 20 comprises a ferrite core. Each ferrite core has the shape of a toroid or its topological equivalent. The current probe 20 may be designed to operate in any desired band. By way of non-limiting example, the current probe 20 may be designed to transmit and receive in the High Frequency (HF) range (2-100 MHz), the Very High Frequency (VHF) range (100-400 MHz), the Ultra High Frequency (UHF) range (400-1000 MHz), and/or the L-band range (1000-2000 MHz). In FIG. 2, the current probe 20 is shown placed near the base of the antenna 10, being elevated from the ground plane 12 at a distance of approximately ¾ of an inch via spacers 25 formed from any non-metallic low permittivity material such as rubber. A non-limiting example of a current probe 20 is a Fisher Custom Communications RF Current Probe (1 MHz-400 MHz) approximately 6 inches in diameter and approximately 2 inches in height, with an inside open diameter of approximately 3 inches.

Figure 3:
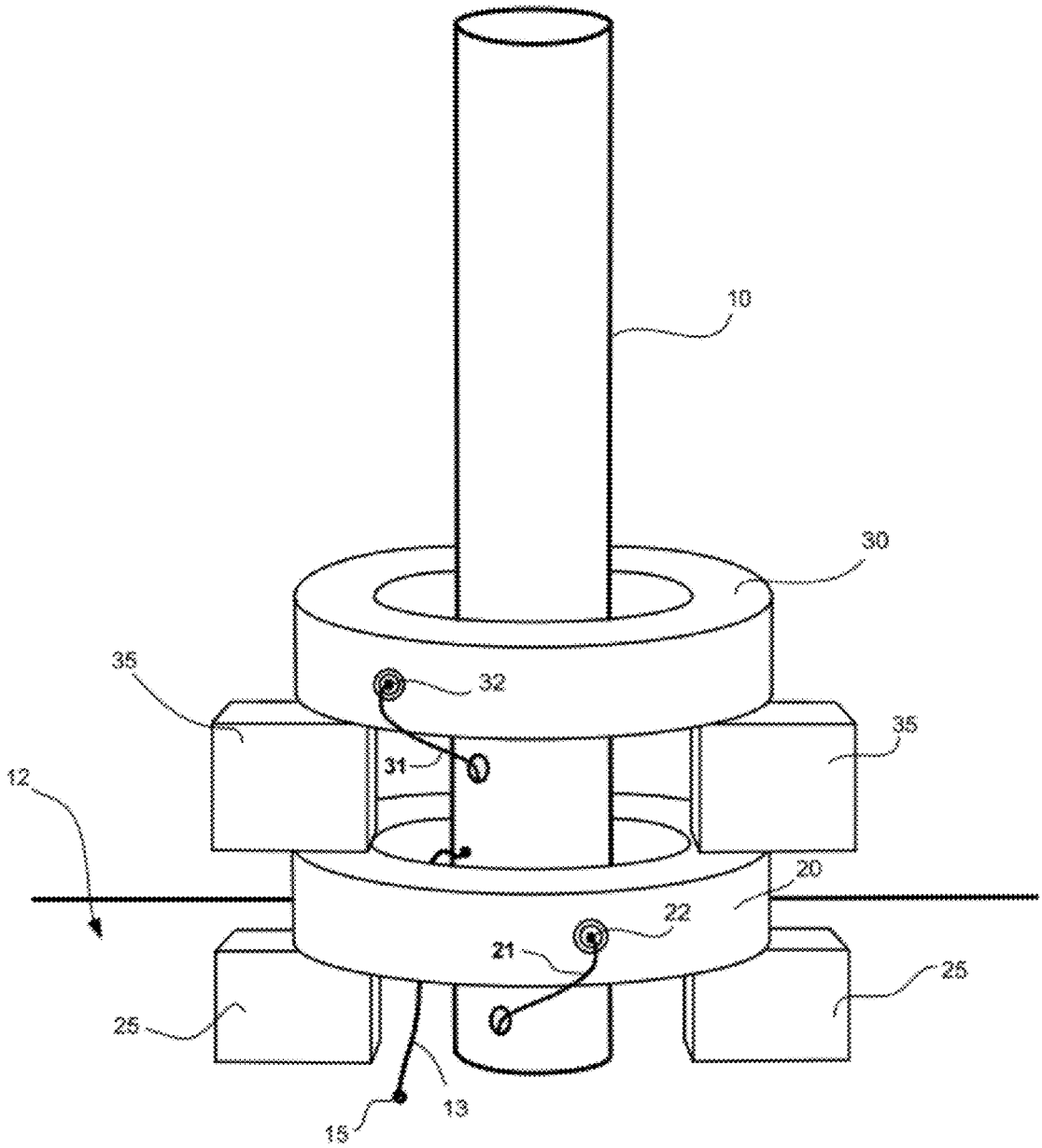
FIG. 3 is an illustration of the setup of FIG. 2 with two current probes.

FIG. 3 is an illustration of the setup of FIG. 2 with two current probes. Here, a second current probe 30 is shown placed above the first current probe 20, supported by spacers 35, of approximately 1 inch in height. The spacers 35 may be made of any non-metallic low permittivity material including, for example, Styrofoam. Signal coupler port 32 for the second current probe 30 is shown. As an example of a second current probe 30 is Fisher Custom Communications RF Current Probe (10 KHz-1 GHz), being approximately 2 inches in height, 5½ inches in diameter, with an inside open diameter of approximately 3 inches. In the setup illustration shown in FIG. 3, the signal coupler port 22 is attached to a second signal line 21, which is routed interior to the antenna 10. In addition, the signal coupler port 32 is attached to a third signal line 31, which is also routed interior to the antenna 10.

Figure 4:
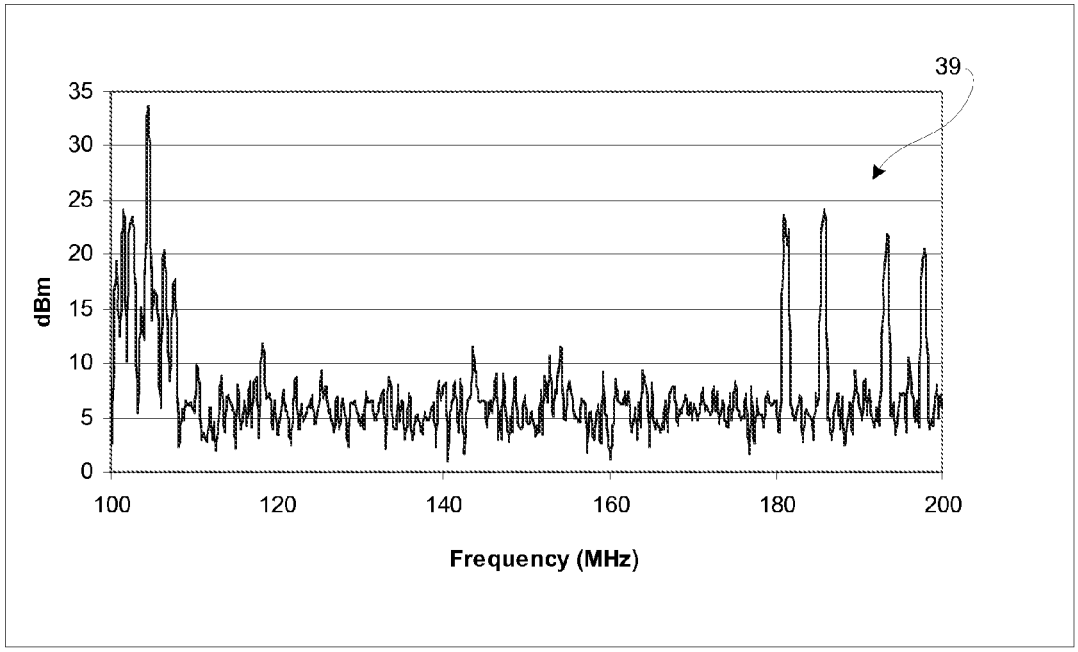
FIG. 4 is a signal level plot of the test antenna setup of FIG. 1.

FIG. 4 is a signal level plot of the test antenna setup of FIG. 1. The plot shows various signals spanning approximately 100-200 MHz, arriving from the antenna 10. Of note are the upper 4 signals 39 between 180-200 MHz, having approximately a magnitude of somewhere between 20-25 dBm. These 4 signals 39 are fixed signals arising from nearby radio stations. The purpose of this plot is to provide a snap shot of the ambient signals. As different current probes are mounted, the change in the ambient signals will be noted, to see the impact of the current probes on these existing signals.

FIG. 5A is a signal level plot of the test antenna setup of FIG. 1 with a splitter 37 attached to the signal line 13, with one end of the splitter being terminated with a 50Ω load, such as is shown in FIG. 5B. As is evident in the plot, all of the signals 39 demonstrate a significant drop in their strength, of approximately 3-5 dBm. This plot confirms the understanding that the addition of a splitter significantly affects the strength of the incoming signal at the analyzer 18.

Figure 6:
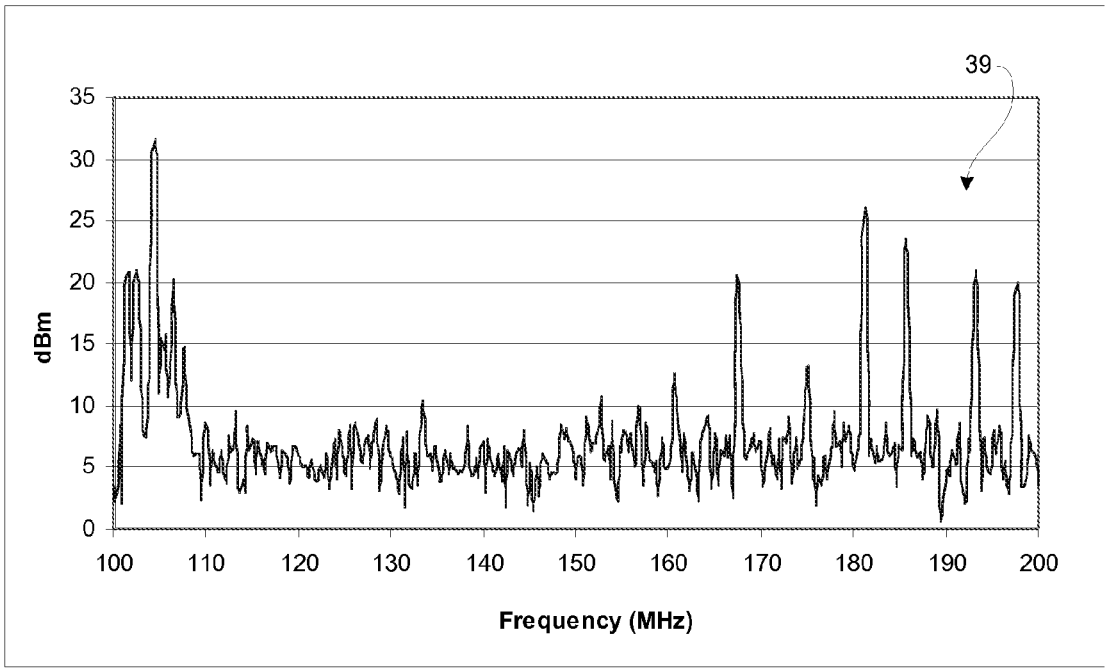
FIG. 6 is a signal level plot of the test antenna setup of FIG. 2 with the current probe terminated with a 50Ω load.

FIG. 6 is a signal level plot of the test antenna setup of FIG. 2 with the current probe 20 terminated with a 50Ω load. Here, only a single current probe 20 is utilized, wherein the effect of the presence of the current probe 20 around the antenna 10 is evaluated. The plot shows that the upper 4 signals 39 in the 180-200 MHz range are only slightly affected from that of the case of not having a current probe 20 (See FIG. 4). Consequently, the addition of the current probe 20 does not significantly reduce the signal levels from the antenna 10.

Figure 7:
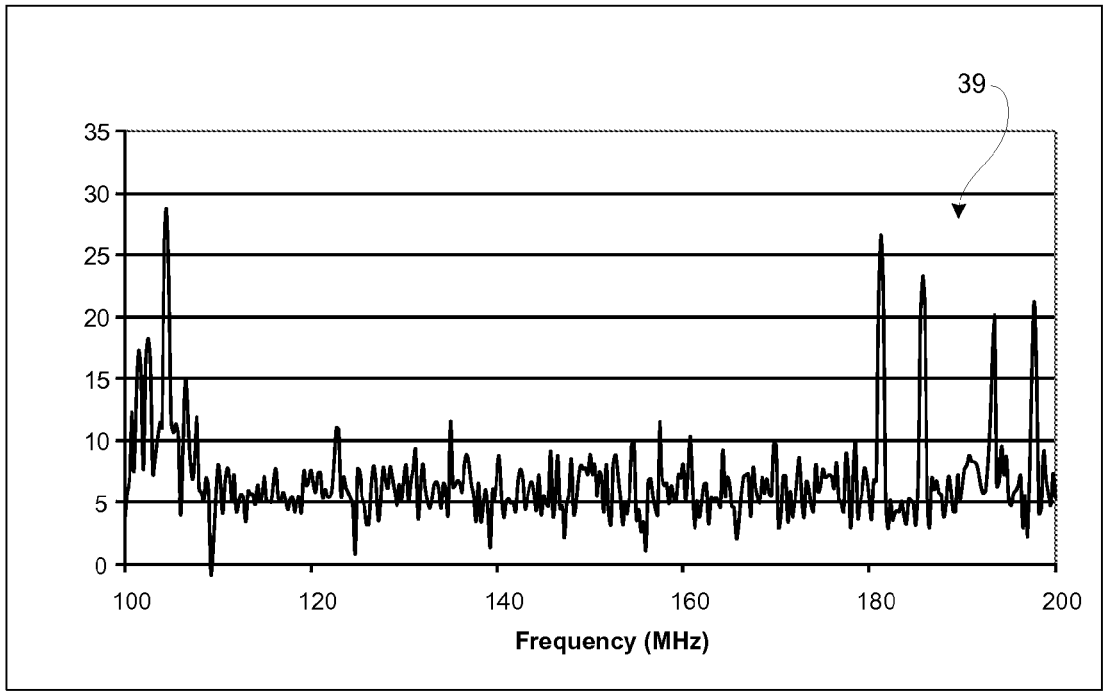
FIG. 7 is a signal level plot of the test antenna setup of FIG. 3 with both current probes terminated with 50Ω loads.

FIG. 7 is a signal level plot of the test antenna setup of FIG. 3 with both current probes terminated with 50Ω loads. Here, both current probes 20, 30 are mounted on the antenna and terminated with matched loads. The plot shows that the signal levels for the upper 4 signals 39 in the 180-200 MHz range are not significantly affected. It is noted that the two "major" signals in the 160-170 MHz range of FIG. 6 are no longer evident in FIG. 7. This may be attributed to the presence of the second current probe 30 on the antenna 10, or it may be simply that these signals are time variant and therefore not transmitted during the sample window for FIG. 7's plot.

Figure 8:
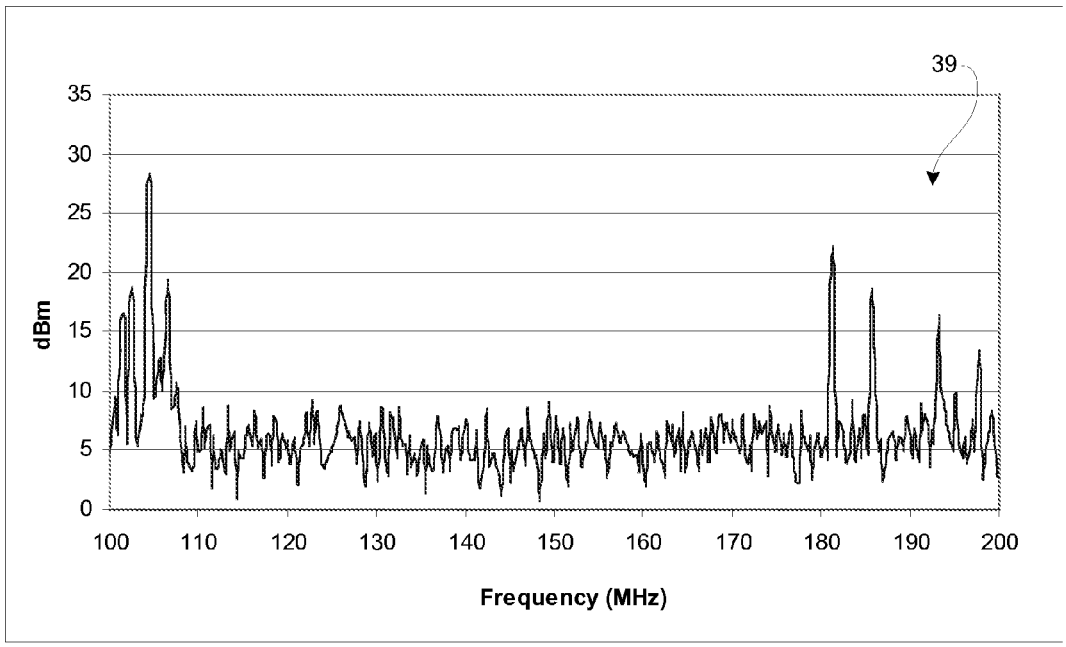
FIG. 8 is a signal level plot of the test antenna setup of FIG. 2 with the current probe connected to the analyzer.

FIG. 8 is a signal level plot of the test antenna setup of FIG. 2 with the current probe 20 connected to the analyzer 18. Here, only one current probe 20 is mounted on the antenna 10 and its signal is fed into the analyzer 18. The signal line 13 from the antenna 10 to the analyzer 18 is disconnected and terminated with a 50Ω load. The plot registers the output of the current probe 20. It is noted that that the current probe 20 is broadband and, therefore, it should pick up the same frequencies of the overall antenna 10. The plot shows that the levels of the various signals 39 between 180-200 MHz are significantly lower than that of the antenna's 10, showing that the probe's gain is less than that of the antenna.

Figure 9:
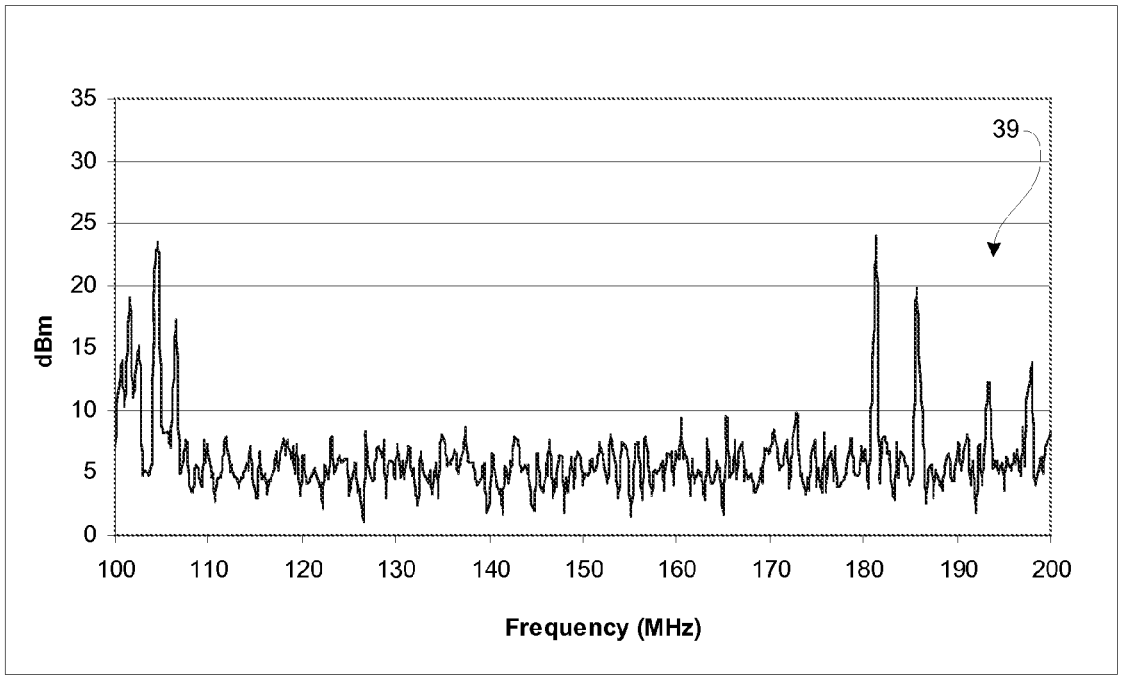
FIG. 9 is a signal level plot of the test antenna setup of FIG. 3 with the lower current probe connected to the analyzer and the upper current probe terminated with a 50Ω load.

FIG. 9 is a signal level plot of the test antenna setup of FIG. 3 with the lower current probe 20 connected to the analyzer 18 and the upper current probe 30 terminated with a 50Ω load. This configuration differs from FIG. 8's configuration only in that another current probe 30, terminated with 50Ω, has been added. The effect of the addition of another current probe 30 to the output of the first current probe 20 is mixed in that the signal level for the 4 signals 39 in the 180-200 MHz range appears to be slightly reduced while the peaks at the bottom of the plot (100-105 MHz) appear to have dropped significantly. Though there is a marked change in the signal levels, all of these signals 39 are still above the noise floor threshold.

Figure 10:
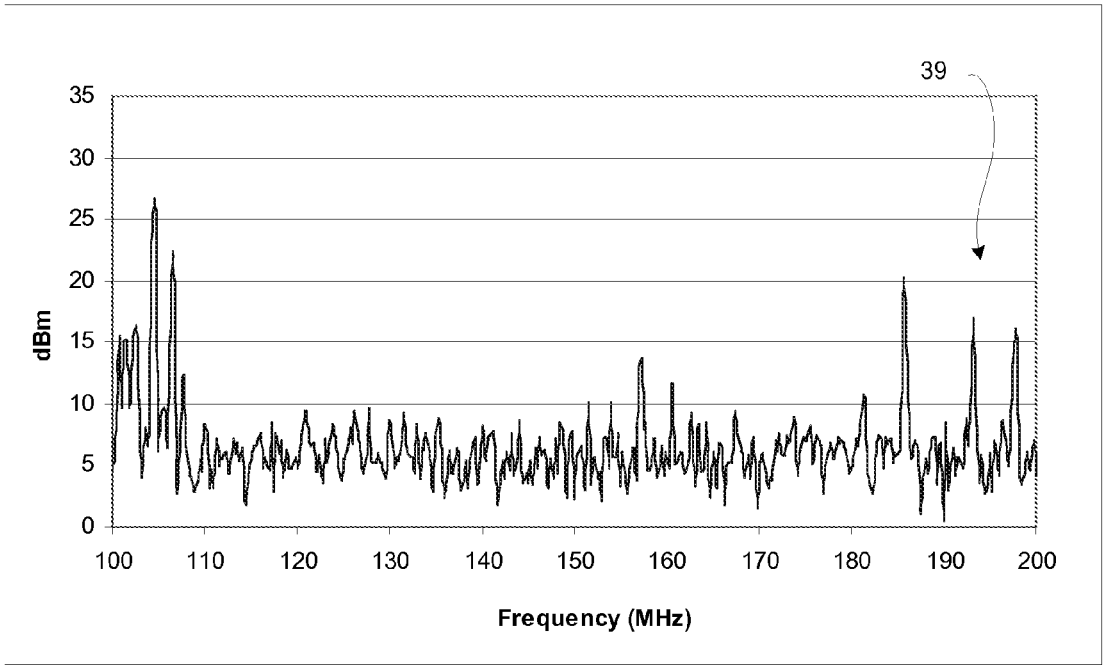
FIG. 10 is a signal level plot of the test antenna setup of FIG. 3 with the upper current probe connected to the analyzer and the lower current probe terminated with a 50Ω load.

FIG. 10 is a signal level plot of the test antenna setup of FIG. 3 with the upper current probe 30 connected to the analyzer 18 and the lower current probe 20 terminated with a 50Ω load. The only difference in this setup versus the setup of FIG. 9 is that the signal line to the analyzer 18 is connected to the "other" probe instead, the other probe being the upper probe 30. The plot shows a marked drop in the amplitude of several of the signals 39 in the 180-200 MHz range. Of note is that the first signal (around 182 MHz) see in FIG. 9 is practically absent in FIG. 10's plot. Also, it appears that some signals in the middle band (140-160 MHz) are more pronounced than in FIG. 9's.

The plot in FIG. 10 shows that the signal picked up by the secondary current probe 30 will be "less" than the signal picked up by the first current probe 20. However, with the exception of the first signal (~182 MHz) of FIG. 9, all of FIG. 9's signals 39 seem to be detected by the second probe 30. Consequently, it appears that the addition of the second probe 30, though not providing the same sensitivity for all frequencies found in the first probe 20, can still pick up the bulk of signals 39. This conclusion is consistent with current distribution theory for a monopole antenna, where the current is known to be at its maximum near the base of the monopole antenna, tapering to a near zero value at the top of the antenna.

The combination of the plots from FIGS. 9 and 10 demonstrate that each current probe is capable of picking up the bulk of signals that the other current probe is capable of, as well as not significantly affecting the performance of the existing antenna 10 (FIG. 7). Consequently, layering or stacking or adding current probes to an existing antenna can be seen as an acceptable way to retrieve signals without requiring the use of a splitter. In some embodiments, due to the reduced current on the top end of the antenna 10, it may be desirable to utilize a larger current probe or a more sensitive current probe to compensate for the reduced H fields.

Figure 11:
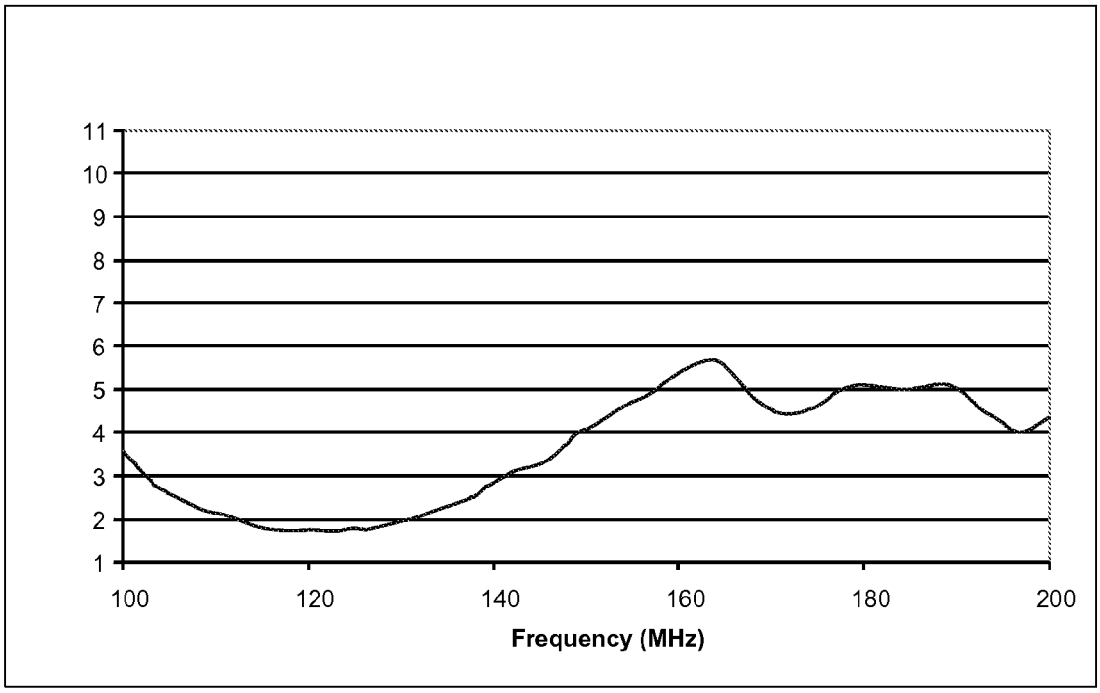
FIG. 11 is a voltage standing wave ratio (VSWR) plot of the test antenna setup of FIG. 1.

FIG. 11 is a VSWR plot of the test antenna setup of FIG. 1. This plot provides the "baseline" plot for comparison as current probes are added to the antenna 10. One of ordinary skill is aware that the higher the VSWR, the more reflections are occurring from the antenna input, which means that energy is not being efficiently transmitted from the source to the load (or vice versus). Therefore, a large or increasing VSWR is not desirable in the antenna arts. However, most antenna systems are considered "acceptable" if the VSWR is maintained below 5. As is apparent in FIG. 11, at about 160 MHz, the VSWR crosses over 5 and undulates between 4 and 5 up to 200 MHz. This shows that the antenna 10 of FIG. 11 is more suited for the lower frequency bands.

Figure 12:
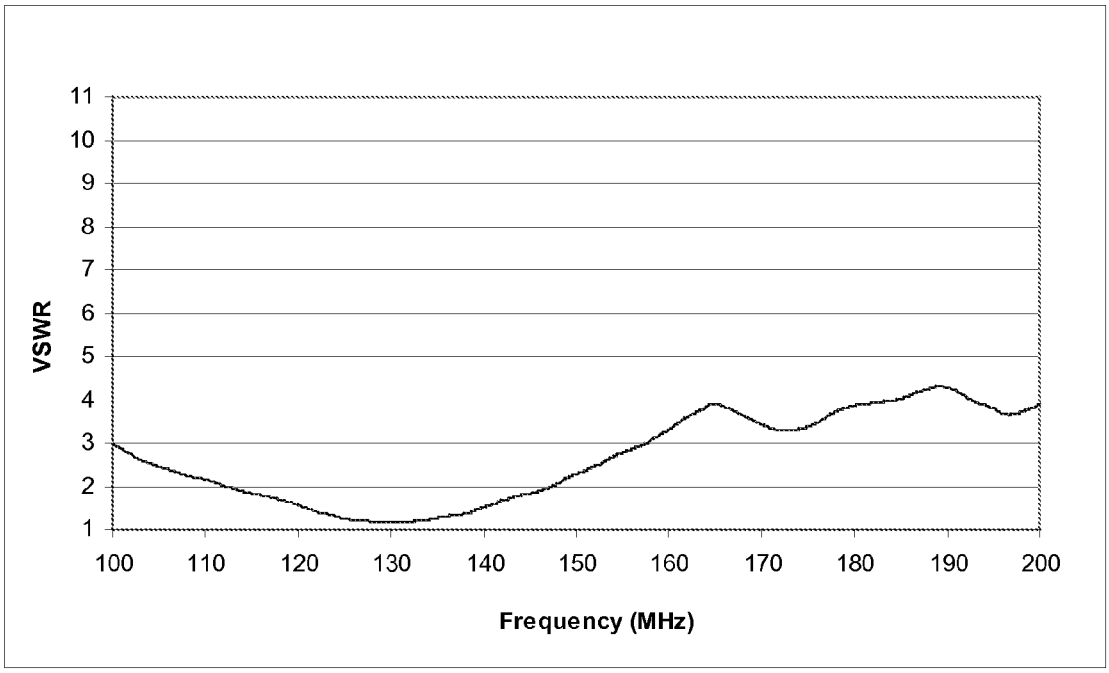
FIG. 12 is a VSWR plot of the test antenna setup of FIG. 2.

FIG. 12 is a VSWR plot of the test antenna setup of FIG. 2. Here, a single current probe 20 is configured around the antenna 10, the current probe 20 being terminated in 50Ω, and the VSWR being measured from the antenna 10. It is noted that the VSWR drops dramatically at the upper end of the frequency range, going below the 5 threshold seen in FIG. 11. This shows that the addition of the single current probe 20 actually reduces the VSWR of the antenna 10, improving its response. Consequently, an arbitrary antenna having, perhaps, a less than ideal upper frequency response (VSWR), can be rehabilitated by adding a current probe. Since the current probe can also act as a signal tap (without reducing the signal from the antenna), this configuration not only increases the performance capabilities of the existing antenna, it also provides a second signal channel, without diminishing the existing antenna's signal.

Figure 13:
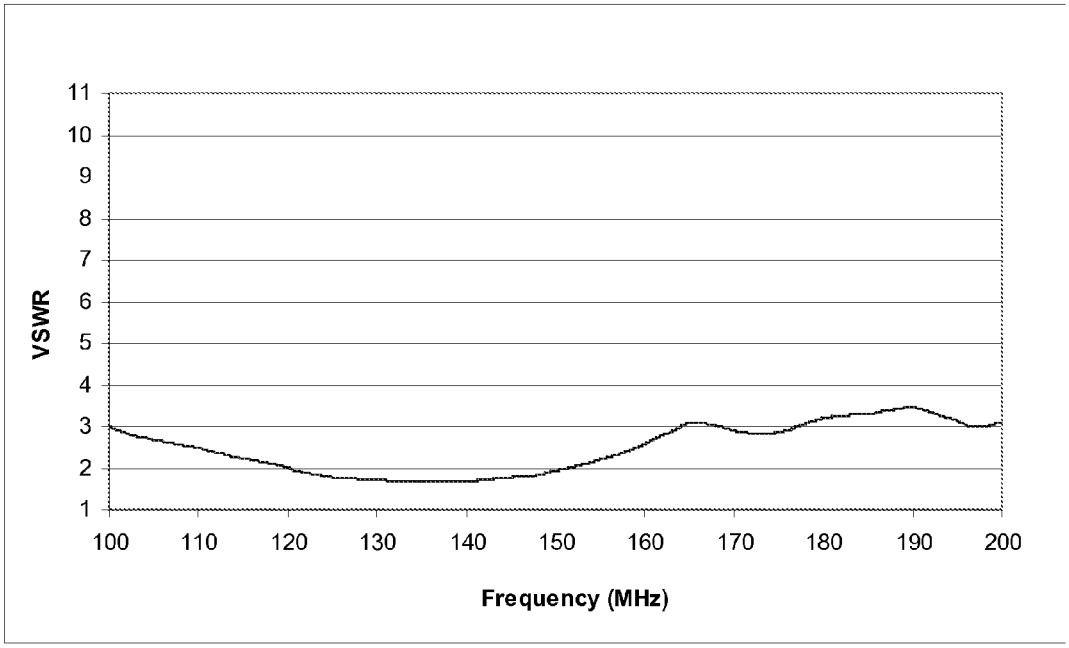
FIG. 13 is a VSWR plot of the test antenna setup of FIG. 3.

FIG. 13 is a VSWR plot of the test antenna setup of FIG. 3 with the signal coming from the antenna 10. Here, both current probes 20, 30 are placed around the antenna 10, with the current probes both terminated with 50Ω loads. It is clearly apparent that the overall VSWR is much smoother than that of FIG. 11's VSWR plot. The VSWR near the lower frequency range around 100 MHz is reduced, while the VSWR from 120-160 MHz is slightly elevated. From 160 MHz to 200 MHz, the VSWR is smooth and stays below 4. The overall effect is that all of the VSWR is below 4 with significant improvement at the lower and upper frequency ranges.

Figure 14:
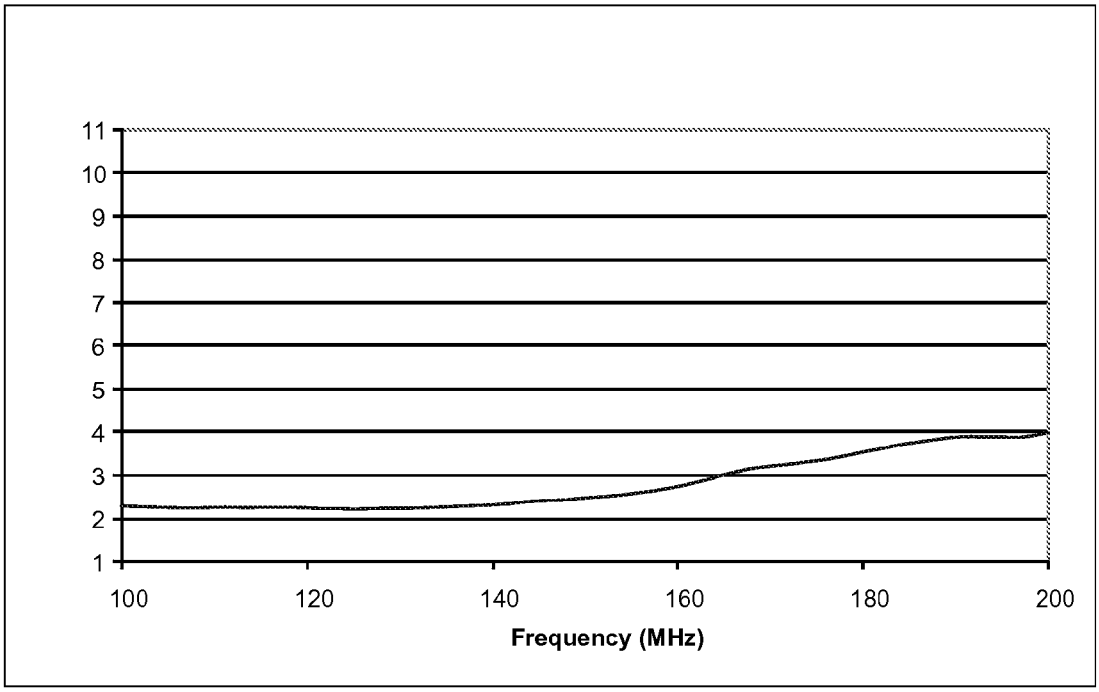
FIG. 14 is a VSWR plot of the test antenna setup of FIG. 3, with the signal from the lower current probe.

FIG. 14 is a VSWR plot of the test antenna setup of FIG. 3, with the signal coming from the lower current probe 20. The upper current probe 30 is terminated with a 50Ω load and the antenna 10 is terminated with a 50Ω load. The VSWR plot shows that the current probe 20 is operating with a very good VSWR response.

Figure 15:
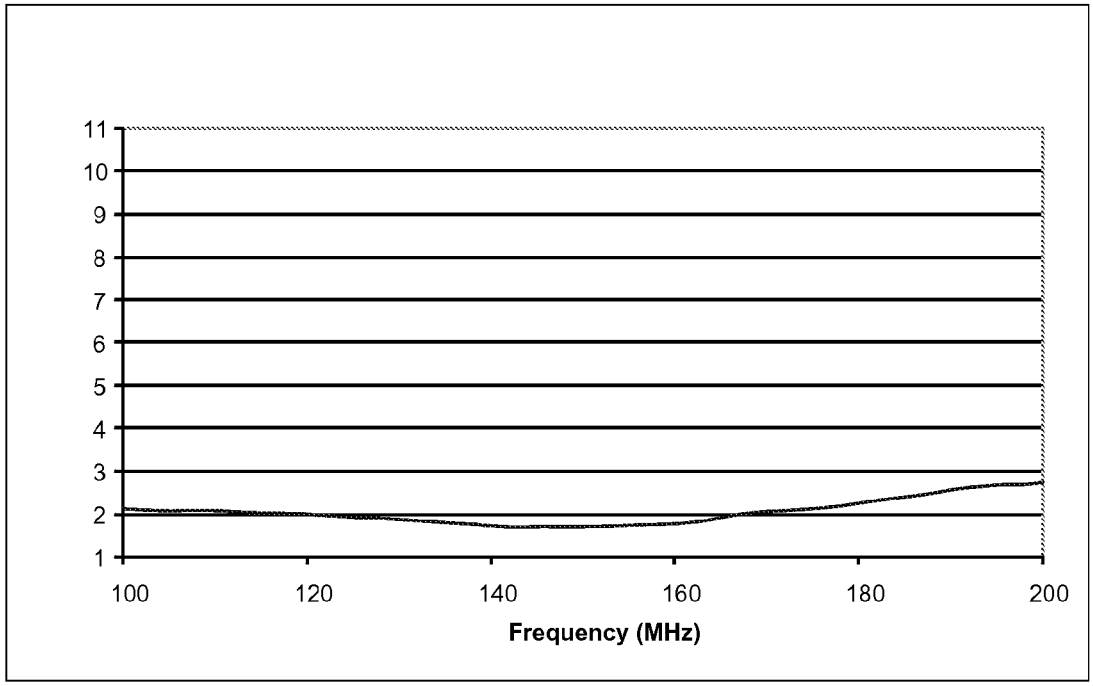
FIG. 15 is a VSWR plot of the test antenna setup of FIG. 3, with the signal from the upper current probe.

FIG. 15 is a VSWR plot of the test antenna setup of FIG. 3, with the signal coming from the upper current probe 30. The lower current probe 20 is terminated with a 50Ω load and the antenna 10 is terminated with a 50Ω load. The VSWR plot shows that the current probe 30 is operating with very good VSWR.

Figure 16:
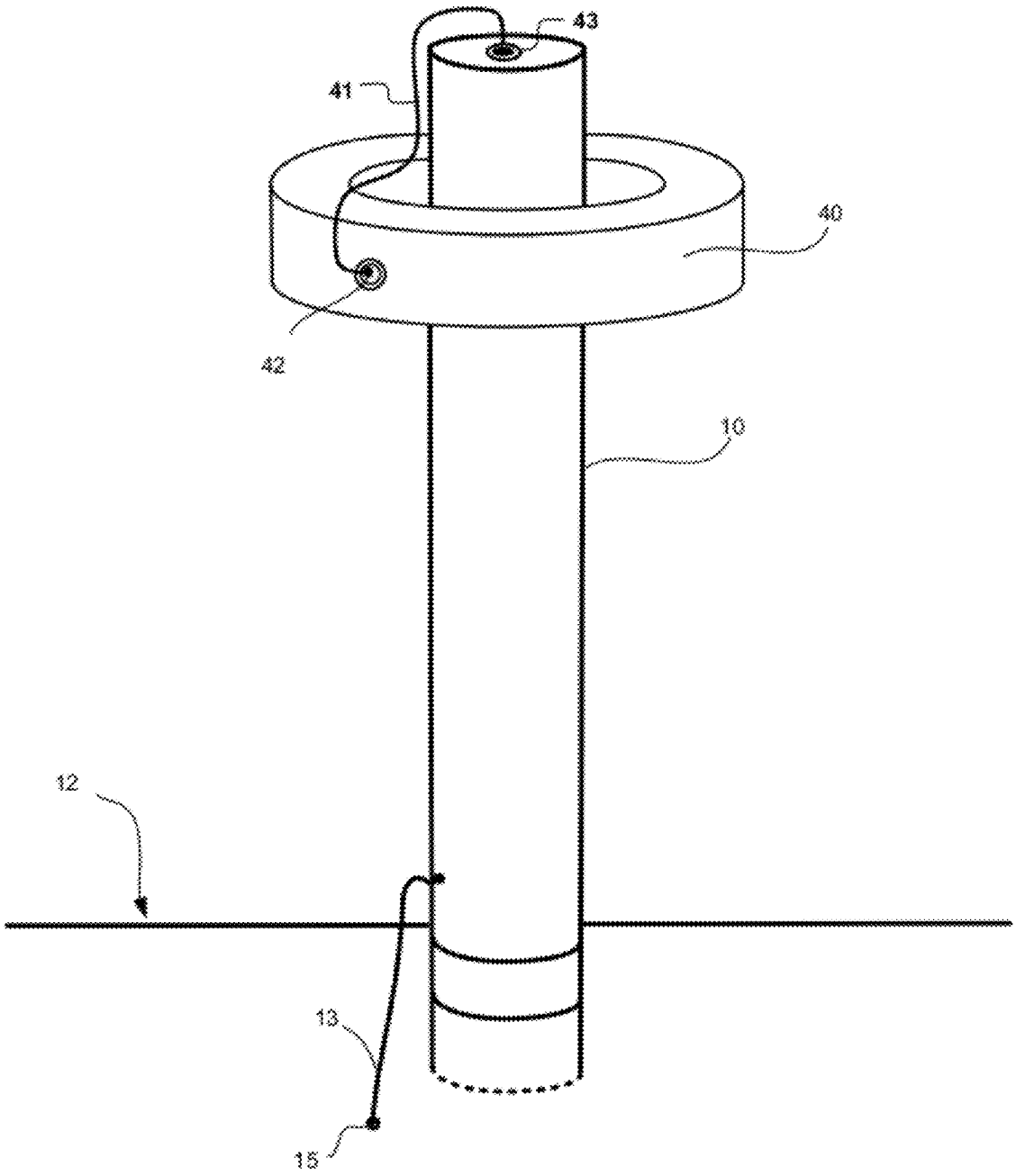
FIG. 16 is an illustration of a conversion of a low-band antenna to a low+high band antenna.

FIG. 16 is an illustration of a conversion of a low-band antenna to a low+high band antenna. Here, the current probe 40 is placed near the upper end of the antenna 10 (supports not being shown) having coupler port 42. The significance of placing the current probe 40 near the upper end of the antenna 10 is that it is understood that higher order modes and/or frequencies of transmitted or received signals are naturally found at the upper end of the antenna 10. Thus, the current probe 40, at this position on the antenna, is better suited to detecting these signals than the overall antenna 10 because the antenna's signal line 13 is situated near the bottom end of the antenna 10. In consideration of the reduced currents near that top of the antenna 10, the above configuration can conform a lower frequency antenna to have higher frequency capabilities, as made evident in the preceding figures and descriptions, and also provide another signal line path for another receiver/transmitter (not shown). In the illustration shown in FIG. 16, the signal coupler port 42 is attached to a third signal line 41, which is routed interior to the antenna 10 through a top access port 43 of the antenna 10.

It should be noted that in the above figures showing the antenna configurations, the signal line 13 is illustrated as being placed exterior to the antenna 10. In alternate configurations, it is possible to have the signal line 13 either tapped from the interior of the antenna or fed through a via into the hollow center of the antenna 10, thus avoiding coupling effects, understanding that the fields within a closed conductive object are zero. Similarly, signal lines connecting the coupler ports of 22, 32, and 42 may be fed through the center of the antenna 10, either through a top access port (such as is shown in FIG. 16) or through vias put into the side of the antenna 10 (such as is shown in FIG. 3). As should be apparent to one of ordinary skill in the art, these are only a few of multiple other ways to feed or route antenna (current probes) lines to the receiving/transmitting system, the "other" ways being implementable according to design preference.

The above exemplary embodiments demonstrate that the addition of magnetic couplers (current probes) to an existing antenna can provide a non-signal diminishing method for obtaining a plurality of signals from the antenna, and also improve the signal response of the antenna (VSWR). Each current probe can operate as an independent antenna (so to speak). Thus, the exemplary embodiments can be used as a scheme for retro-fitting existing antennas for increased capabilities without requiring significant modifications thereto.

What has been described above includes examples of one or more embodiments. It is, of course, not possible to describe every conceivable combination of components or methodologies for purposes of describing the aforementioned embodiments. It will, therefore, be understood that many additional changes in the details, materials, steps and arrangement of parts, which have been herein described and illustrated to explain the nature of the invention, may be made by those skilled in the art within the principal and scope of the invention as expressed in the appended claims.

I claim:

1. A method for converting an existing antenna capable of generating H fields having a first signal line into a multi-signal line antenna with increased frequency capabilities, comprising:

providing an existing non-current-probe-fed antenna configured to operate in a first frequency range;

providing a first signal line electrically coupled to the existing antenna;

mounting a first current probe about a periphery of the existing antenna such that a first section of the existing antenna is positioned within an aperture of a ferromagnetic core of the first current probe, wherein the first current probe is designed to operate in a second frequency range, and wherein the second frequency range is different than the first frequency range;

coupling a second signal line to the first current probe;

performing at least one of transmitting and receiving via at least one of the first and second signal lines, wherein the mounting of the first current probe to the existing antenna improves a voltage standing wave ratio (VSWR) of the existing antenna and the second signal line operates as an independent signal line for signal reception/transmission within the second frequency range;

mounting a second current probe about the periphery of the existing antenna such that a second section of the existing antenna is positioned within an aperture in a ferromagnetic core of the second current probe, wherein the second current probe is designed to operate in a third frequency range, and wherein the third frequency range is different than the first and second frequency ranges; and coupling a third signal line to the second current probe, wherein the at least one of the transmitting and receiving is performed via at least one of the first, second and third signal lines.

2. The method of claim 1, wherein the first current probe is mounted near a ground plane of the existing antenna.

3. The method of claim 1, wherein the first current probe is mounted near a top of the existing antenna.

4. The method of claim 1, wherein the core of the first current probe is in a toriodal shape.

5. The method of claim 4, wherein the core of the second current probe is in a toriodal shape.

6. The method of claim 1, wherein the signal lines are routed exterior to the existing antenna.

7. The method of claim 1, wherein the existing antenna is hollow and the second signal line is routed interior to the existing antenna.

8. An antenna system for converting an existing non-current-probe-fed antenna capable of generating H fields having a first means for conveying a signal into a multi-signal line antenna with increased frequency capabilities, comprising:

first means for detecting H fields, the first means having a designated frequency range and being mounted about a periphery of the existing antenna;

second means for conveying a signal to the first means for detecting;

second means for detecting H fields, the second means having a designated frequency range about the periphery of the existing antenna; and third means for conveying a signal to the second means for detecting, wherein the at least one of the transmitting and receiving is performed via at least one of the first, second and third conveying means; and means for performing at least one of transmitting and receiving via at least one of the first and second means for conveying, wherein the mounting of the first means for detecting to the existing antenna improves a voltage standing wave ratio (VSWR) of the existing antenna and the second means for conveying operates as an independent line for signal reception/transmission within the designated frequency range.

9. The system of claim 8, wherein the first means for detecting is in a toriodal shape.

10. The system of claim 8, wherein the second means for detecting is in a toriodal shape.

11. The system of claim 8, wherein the means for conveying are routed exterior to the existing antenna.

12. The system of claim 8, wherein the means for conveying are routed interior to the existing antenna.

13. An antenna system comprising:

an existing, non-current-probe-fed, monopole antenna configured to operate in a first frequency range;

a dielectric spacer coupled to the existing antenna such that the existing antenna is electrically separated from a ground plane;

a first signal line electrically coupled to the existing antenna;

a first current probe comprising a ferromagnetic core having an aperture therein and wherein the first current probe is mounted about a periphery of the existing antenna such that a first section of the existing antenna is positioned within the aperture of the first current probe, and wherein the first current probe is designed to operate in a second frequency range, and wherein the second frequency range is different than the first frequency range;

a second signal line coupled to the first current probe;

a transmitter and a receiver coupled to the first and second signal lines, wherein the first current probe improves a voltage standing wave ratio (VSWR) of the existing antenna and the second signal line operates as an independent signal line, separate from the first signal line of the existing antenna, for signal reception/transmission within the first and second frequency ranges;

a second current probe comprising a ferromagnetic core having an aperture therein and wherein the second current probe is mounted about the periphery of the existing antenna such that a second section of the existing antenna is positioned within the aperture of the second current probe, and wherein the second current probe is designed to operate in a third frequency range, and wherein the third frequency range is different than the first and second frequency ranges; and a third signal line coupled to the second current probe, wherein the transmitting and receiving is performed via at least one of the first, second and third signal lines.

14. The system of claim 13, wherein the first current probe is mounted near a ground plane of the existing antenna.

15. The system of claim 13, wherein the first current probe is mounted near a top of the existing antenna.

16. The system of claim 13, wherein the core of at least one of the first and second current probes is in a toriodal shape.

17. The system of claim 16, wherein the second and third signal lines are routed exterior to the existing antenna.

* * * * *